US007854481B2

(12) United States Patent
Fraser

(10) Patent No.: US 7,854,481 B2
(45) Date of Patent: Dec. 21, 2010

(54) METHODS AND APPARATUS FOR ASSEMBLING A WHEEL CHAIR

(75) Inventor: Kevin Gerard Fraser, Belleville, IL (US)

(73) Assignee: Star Cushion Products, Inc., Freeburg, IL (US)

( * ) Notice: Subject to any disclaimer, the term of this patent is extended or adjusted under 35 U.S.C. 154(b) by 0 days.

(21) Appl. No.: 10/867,928

(22) Filed: Jun. 15, 2004

(65) Prior Publication Data

US 2005/0275272 A1 Dec. 15, 2005

(51) Int. Cl.
*A47C 7/00* (2006.01)

(52) U.S. Cl. ..... 297/440.2; 297/DIG. 4

(58) Field of Classification Search ..... 297/440.2, 297/DIG. 2, 440.21, DIG. 4
See application file for complete search history.

(56) References Cited

U.S. PATENT DOCUMENTS

| | | | | |
|---|---|---|---|---|
| 4,684,149 | A | 8/1987 | Meyer | |
| 4,736,960 | A | 4/1988 | Batty et al. | |
| 4,809,998 | A | 3/1989 | Girvin | |
| 4,966,379 | A | 10/1990 | Mulholland | |
| 5,020,816 | A | 6/1991 | Mulholland | |
| 5,062,677 | A | 11/1991 | Jay et al. | |
| 5,127,709 | A | 7/1992 | Rubinstein et al. | |
| 5,188,383 | A | 2/1993 | Thompson | |
| 5,244,222 | A | 9/1993 | Benoit | |
| 5,301,970 | A | 4/1994 | Haskins | |
| 5,364,162 | A * | 11/1994 | Bar et al. | 297/284.8 |
| 5,556,168 | A * | 9/1996 | Dinsmoor et al. | 297/440.2 |
| 5,727,809 | A | 3/1998 | Ordelman et al. | |
| 5,758,897 | A | 6/1998 | Kueschall | |
| 5,947,562 | A * | 9/1999 | Christofferson et al. | 297/440.22 |
| 6,073,958 | A | 6/2000 | Gagnon | |
| 6,257,664 | B1 * | 7/2001 | Chew et al. | 297/284.9 |
| 6,257,665 | B1 * | 7/2001 | Nagamitsu et al. | 297/285 |
| 6,460,927 | B1 * | 10/2002 | Groth | 297/284.9 |
| 6,460,933 | B1 * | 10/2002 | Bors et al. | 297/440.2 |
| 6,688,693 | B2 * | 2/2004 | Christofferson et al. | 297/354.12 |
| 6,709,060 | B1 * | 3/2004 | Su | 297/440.2 |
| 2003/0189306 | A1 | 10/2003 | Chen et al. | |
| 2004/0066081 | A1 | 4/2004 | Dennon et al. | |

* cited by examiner

*Primary Examiner*—David Dunn
*Assistant Examiner*—Erika Garrett
(74) *Attorney, Agent, or Firm*—Armstrong Teasdale LLP

(57) ABSTRACT

A wheelchair back assembly mounts to a pair of spaced apart laterally-aligned support posts of a wheelchair back frame. The back assembly includes a relatively rigid shell member, and a mounting system for coupling the shell member to the wheelchair back frame. The mounting system includes at least a first mounting bracket assembly, a second mounting bracket assembly, and a lateral member that is configured to be coupled to the first and second mounting bracket assemblies. The first mounting bracket assembly is configured to couple to a first of the wheelchair back frame support posts, and the second mounting bracket assembly is configured to couple to the second of the wheelchair back frame support posts. The lateral member is selectively operable to uncouple the shell member from the wheelchair back frame.

39 Claims, 8 Drawing Sheets

METHODS AND APPARATUS FOR ASSEMBLING A WHEEL CHAIR

BACKGROUND OF THE INVENTION

This invention relates generally to wheelchairs, and more particularly, to back assemblies used with wheelchairs.

At least some known wheelchairs include an upholstery sling back that may be removed and/or folded for storage. However, because such wheelchair backs are generally not adjustable, such sling backs may not be comfortable to an individual confined in a wheelchair, and as such, may actually increase the health risks to such individuals. More specifically, the posture of individuals who are confined to wheelchairs may be a significant factor in the health problems associated with the individual. For example, over time, the posture of an individual confined to a wheelchair may increase the individual's risk for progressive spinal deformations, reduced mobility, fatigue, impaired respiration or swallowing, and/or tissue breakdown.

To facilitate reducing the risks of posture-related health problems and to increase the comfort to such individuals, at least some known wheelchairs have replaced the conventional back assemblies with back assemblies that are adjustable. More specifically, at least some known systems have attempted to provide a back assembly that is not only adjustable while a user is seated in the wheelchair, but is also attachable to, and/or detachable from, the wheelchair, while the user is seated in the wheelchair. For example, U.S. Pat. No. 5,556,168 to Jay et al. describes a wheelchair back system that is removably coupled to a wheelchair frame and includes height adjustability, tilt adjustability, and lateral support adjustability. Moreover, because the back system described in U.S. Pat. No. 5,556,168 is detachable from, and/or attachable to, the wheelchair in a single-handed operation that does not require the disengagement of, and/or installation of, other latching hardware from the back system, the back system overcame many of the installation/removal problems associated with other known removable wheelchair back systems.

However, depending on the type of wheelchair used, and/or the dexterity and overall condition of the wheelchair user, attaching or detaching the back system described in U.S. Pat. No. 5,556,168 may still be difficult. For example, the back system includes a pair of hook assemblies which each include a plurality of moving parts which may provide pinch points to the user, and/or locations in which a user's clothing may become entangled. Moreover, if either hook assembly becomes jammed, the back system may require an extensive disassembly to repair the hook assembly.

BRIEF SUMMARY OF THE INVENTION

In one aspect, a wheelchair back assembly for mounting to a pair of spaced apart laterally-aligned support posts of a wheelchair back frame is provided. The back assembly includes a relatively rigid shell member, and a mounting system for coupling the shell member to the wheelchair back frame. The mounting system includes at least a first mounting bracket assembly, a second mounting bracket assembly, and a lateral member that is configured to be coupled to the first and second mounting bracket assemblies. The first mounting bracket assembly is configured to couple to a first of the wheelchair back frame support posts, and the second mounting bracket assembly is configured to couple to the second of the wheelchair back frame support posts. The lateral member is selectively operable to uncouple the shell member from the wheelchair back frame.

In another aspect, a wheelchair is provided. The wheelchair includes a back frame and a back assembly. The back frame includes a pair of spaced-apart support posts. The support posts are substantially laterally-aligned. The back assembly includes a relatively rigid shell member coupled between the pair of support posts, and a mounting system for coupling the shell member to the back frame. The mounting system includes a first mounting bracket assembly, a second mounting bracket assembly, and a lateral member that is coupled therebetween. The lateral member is configured to couple to each of the support posts and is selectively operable to uncouple the shell member from the back frame.

In a further aspect, a method for assembling a back assembly for a wheelchair is provided. The method comprises coupling a first mounting bracket assembly to a first support post of a wheelchair back frame, and coupling a second mounting bracket assembly to a second support post of the wheelchair back frame. The method also comprises coupling a lateral member to a relatively rigid shell member, and coupling the lateral member to the first and second mounting bracket assemblies such that the lateral member is selectively operable to uncouple the shell from the wheelchair back frame.

In yet another aspect, a back assembly for a wheelchair including a pair of laterally-aligned support posts is provided. The back assembly includes a shell member having an upper portion and a lower portion, and a mounting system for coupling the shell member between the support posts. The mounting system includes a first mounting bracket assembly, a second mounting bracket assembly, a coupling assembly, and a lateral member. The first mounting bracket assembly is configured to couple the shell upper portion to a first of the support posts, and the second mounting bracket assembly is configured to couple the shell upper portion to a second of the support posts. The coupler assembly is configured to couple between the first mounting bracket assembly and the shell member, and between the second mounting bracket assembly and the shell member. The lateral member extends across the shell member upper portion and is selectively operable to uncouple the shell member from the coupler assembly.

DETAILED DESCRIPTION OF THE INVENTION

Figure 1:
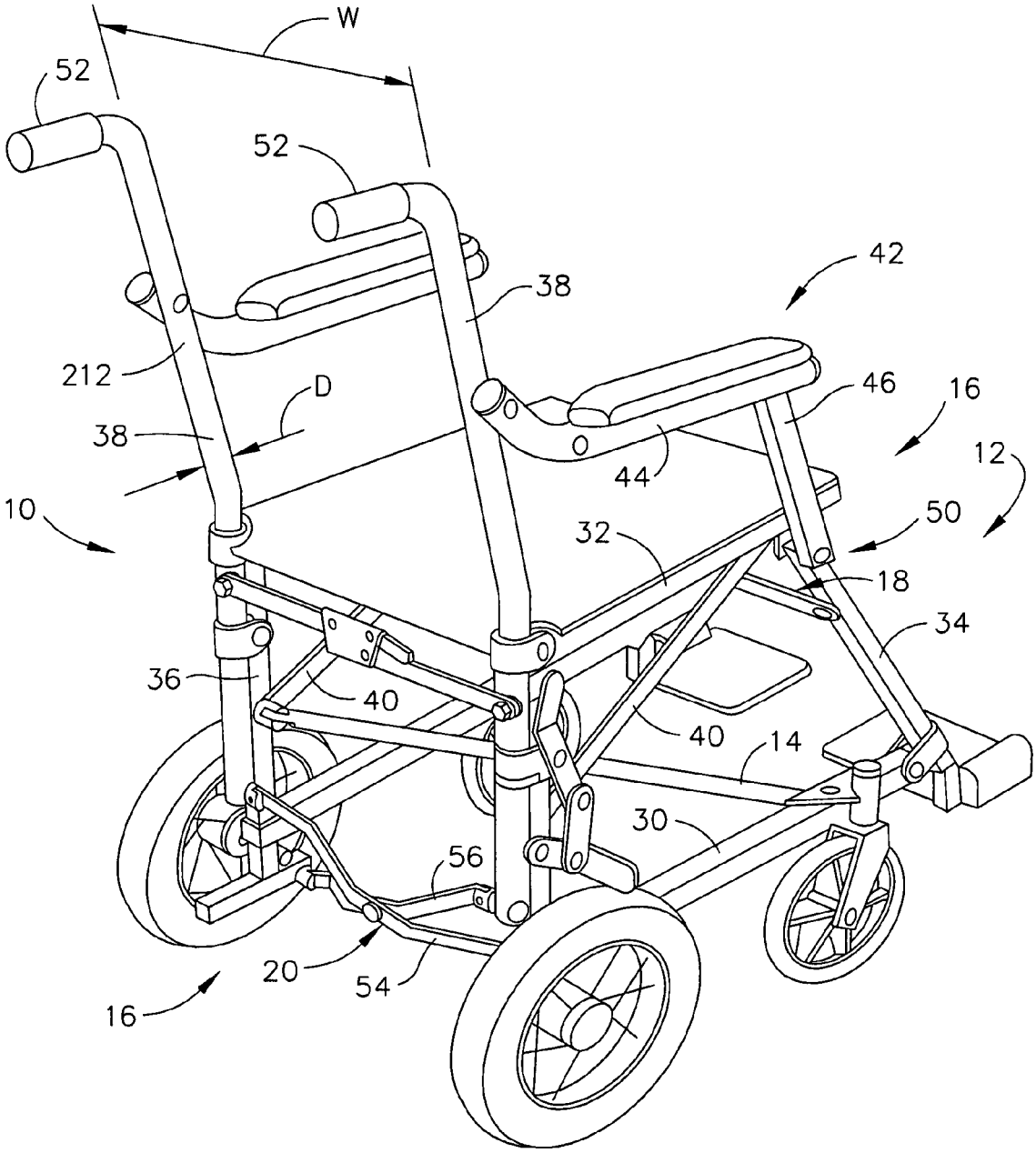
FIG. 1 is a perspective view of an exemplary conventional folding wheelchair.

FIG. 1 is a perspective view of an exemplary folding wheelchair 10. Wheelchair 10 is known in the art and includes a pair of side frames 12 connected by a folding strut arrangement 14 as well as a folding lock arrangement 16 including a front hinged brace 18 and a rear hinged brace 20.

In the exemplary embodiment, each side frame 12 includes a lower frame unit 30, a seat rail 32, a front support unit 34, a back support unit 36, a back frame rail or support post 38, a side connecting link 40, and an armrest support unit 42. Armrest support unit 42 includes a generally horizontally-aligned member 44 and a generally vertically-aligned member 46 that is pivotally coupled between member 44 and an intersection 50 formed by the coupling of front support unit 34, seat rail 32, and side connecting link 40. Each armrest support unit member 44 is coupled between member 46 and back frame support post 38.

Support posts 38 each have a diameter D and are spaced apart a distance W and each extends generally perpendicularly upwardly from lower frame unit 30 to a pair of support post handles 52. Accordingly, posts 38 are substantially parallel to each other, and as such, are generally laterally-aligned. In the exemplary embodiment, posts 38 are also coupled together by a pair of strut members 54 and 56 which are pivotally secured together approximately mid-way along their lengths. More specifically, the upper ends 58 and 60 of respective members 54 and 56 are rotationally, and pivotally, coupled to support posts 38, and are rotationally and pivotally mounted to back support units 36.

Figure 2:
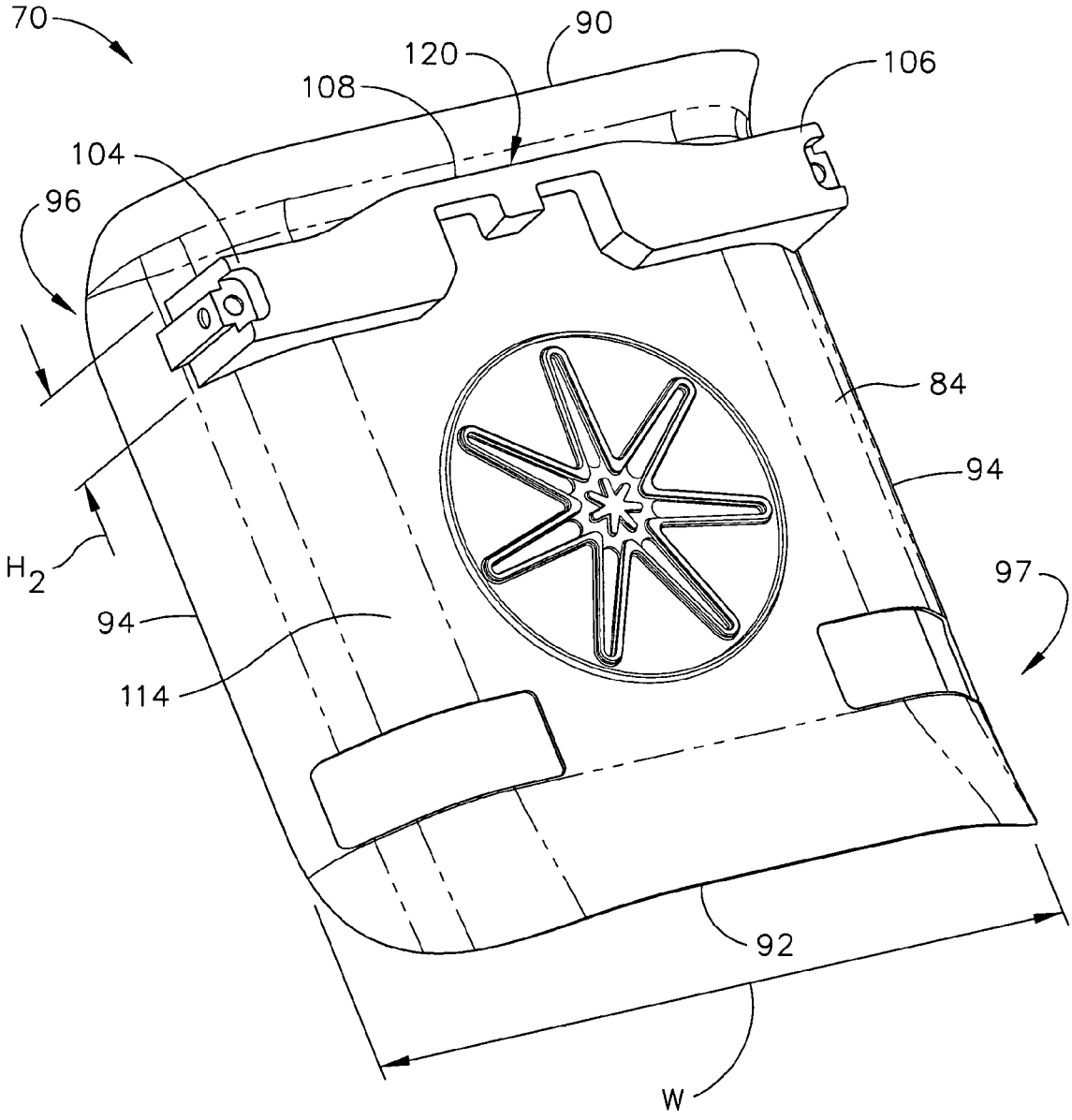
FIG. 2 is a perspective rear view of an exemplary back assembly that may be used with the wheelchair shown in FIG. 1.
Figure 3:
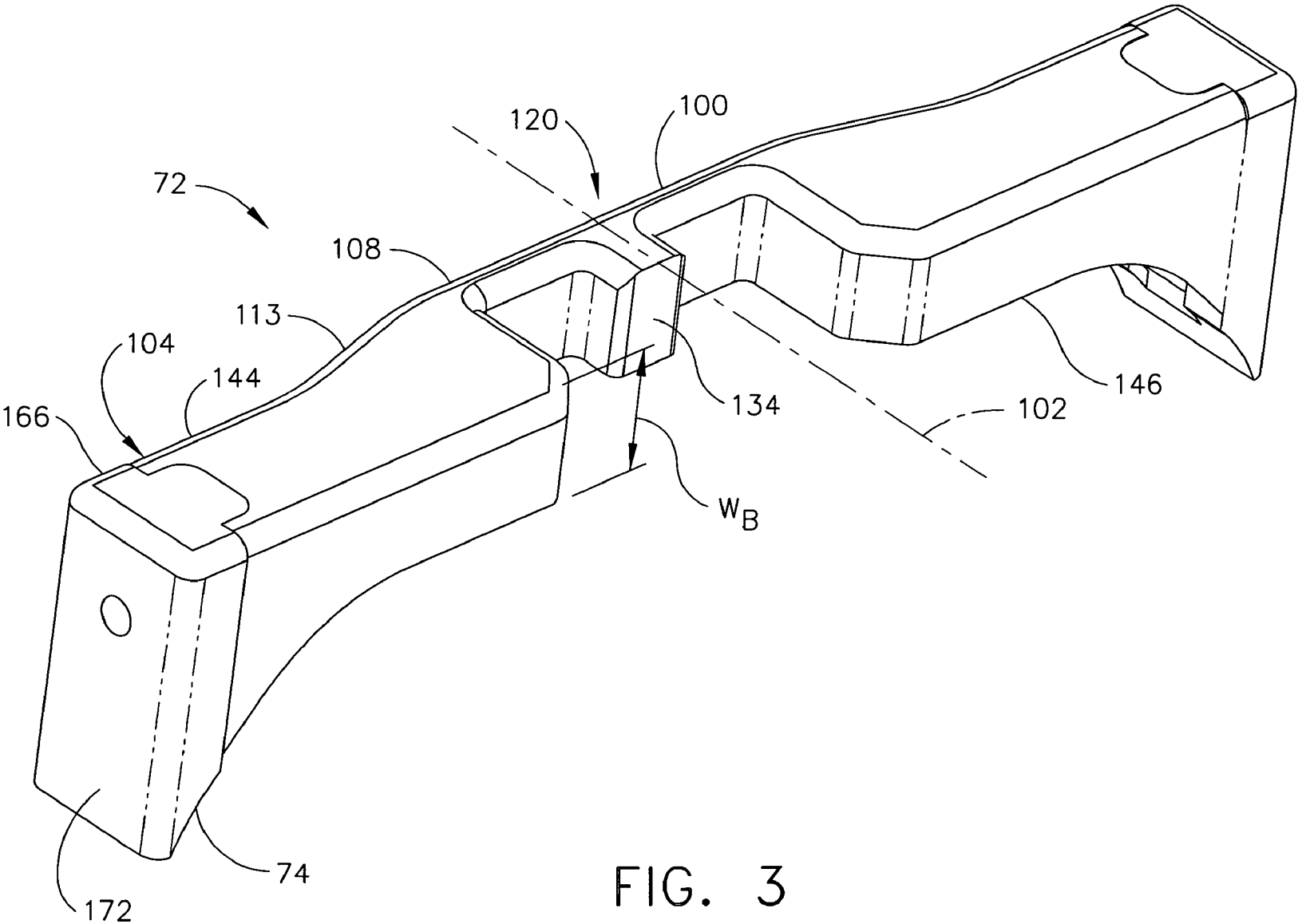
FIG. 3 is an enlarged perspective view of a portion of a mounting system used with the back assembly shown in FIG. 2.
Figure 4:
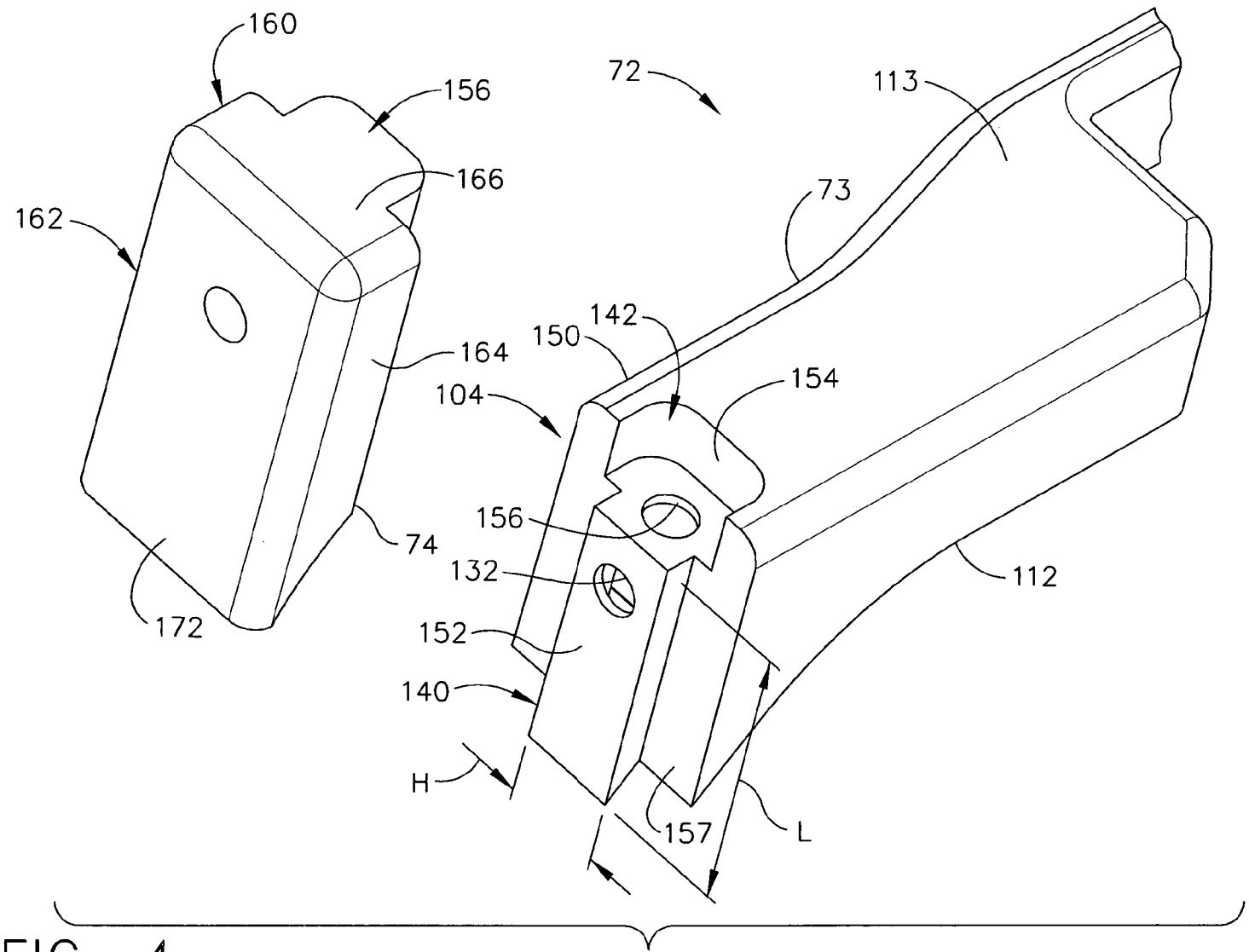
FIG. 4 is an exploded view of the portion of the mounting system shown in FIG. 3.
Figure 5:
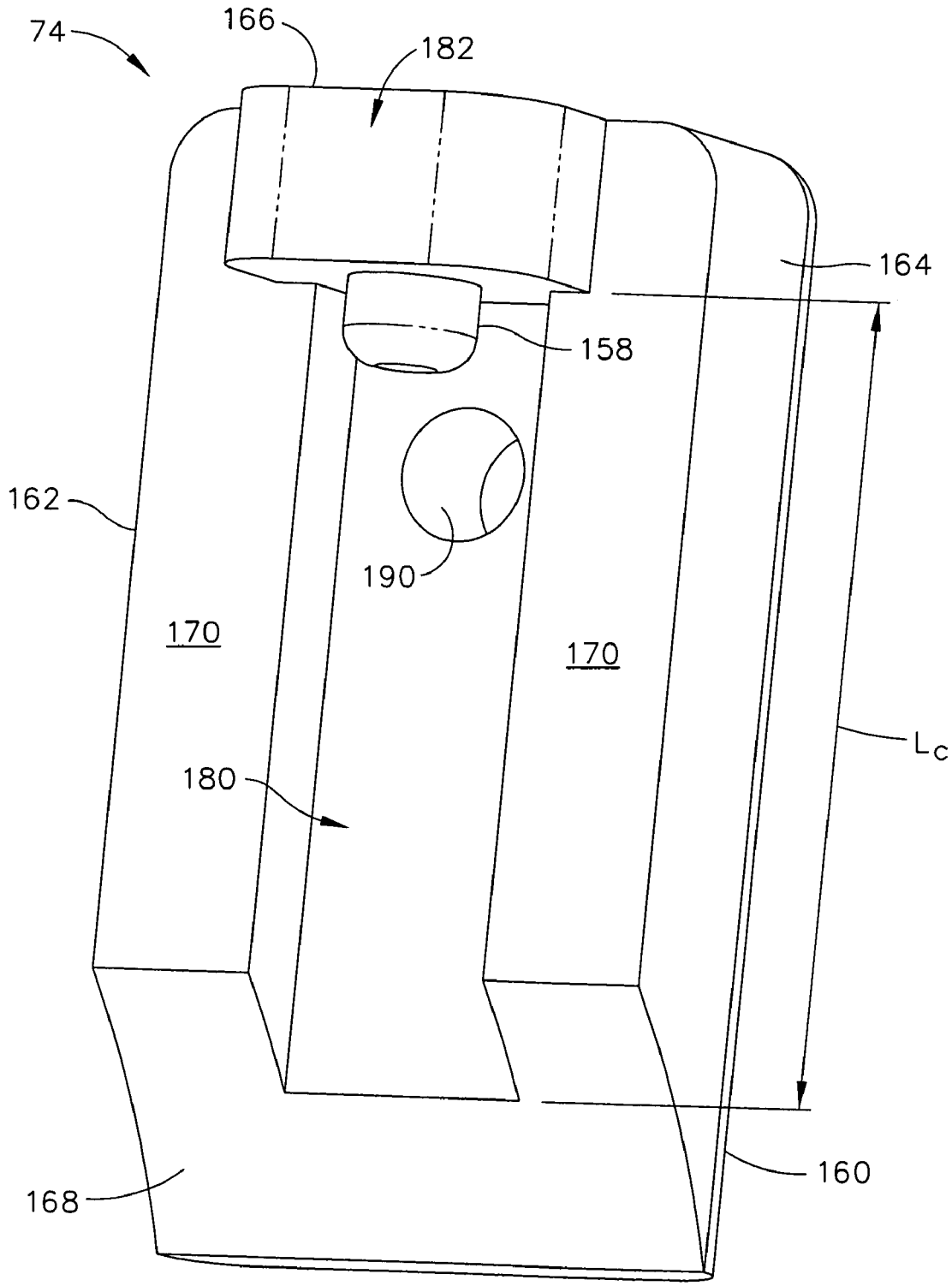
FIG. 5 is a side perspective view of a portion of the mounting system shown in FIG. 4.
Figure 6:
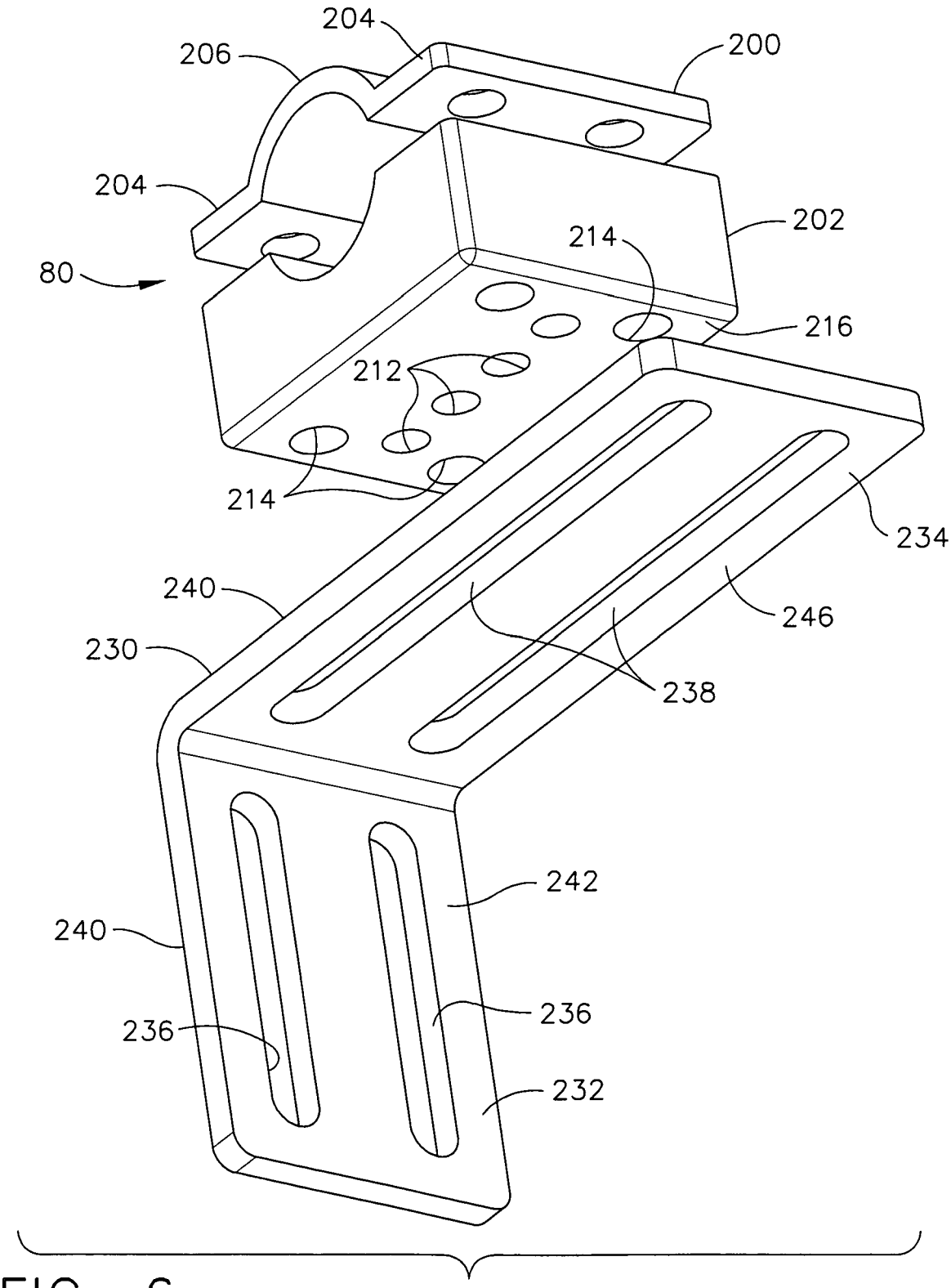
FIG. 6 is an enlarged exploded view of an upper mounting bracket assembly used with the back assembly shown in FIG. 2.
Figure 7:
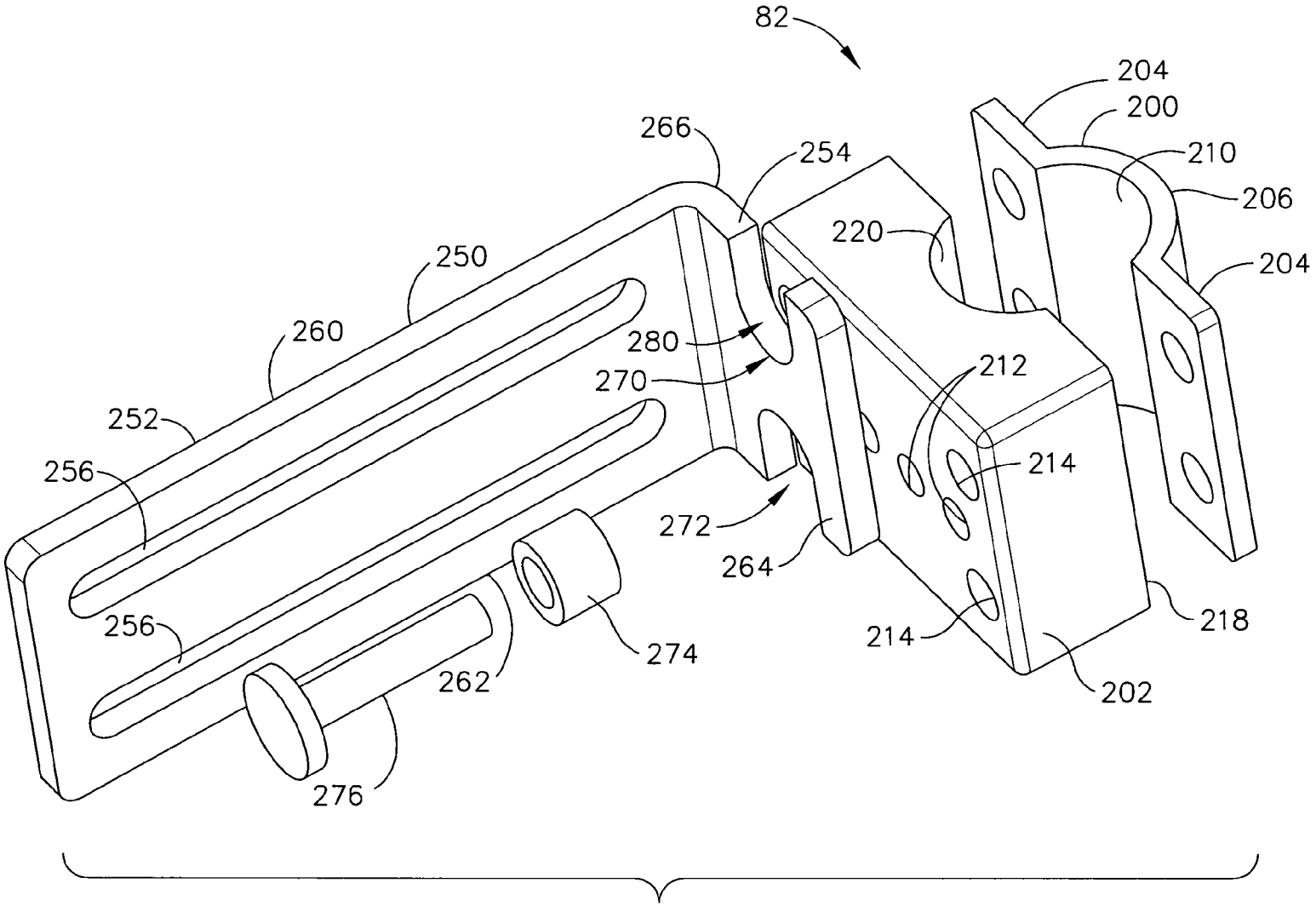
FIG. 7 is a partially exploded enlarged view of a lower mounting bracket assembly used with the back assembly shown in FIG. 2.
Figure 8:
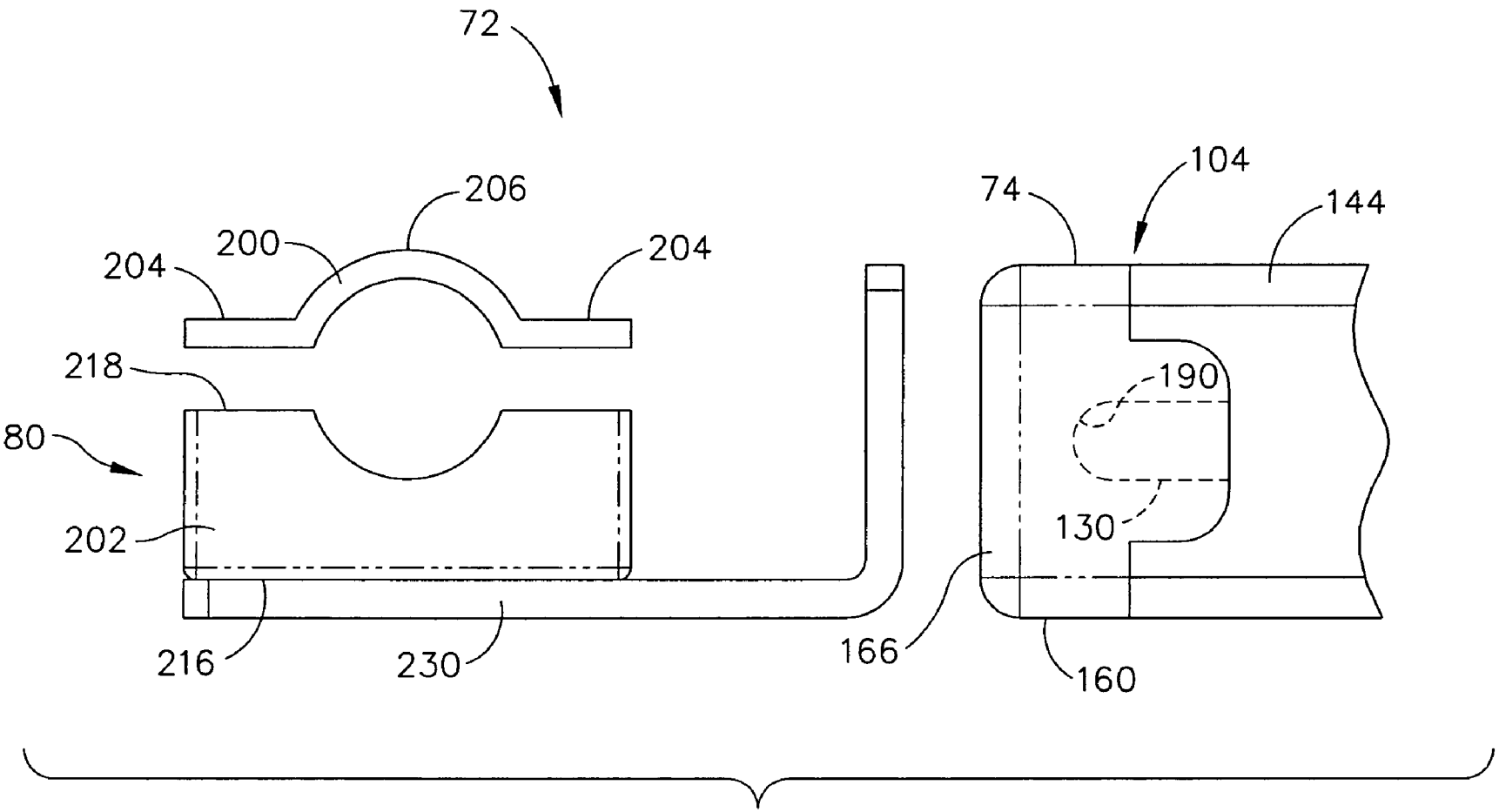
FIG. 8 is a cross-sectional view of the mounting system shown in FIG. 3 and coupled to the upper mounting bracket assembly shown in FIG. 6.

FIG. 2 is a perspective rear view of exemplary back assembly 70 that may be used with a wheelchair, such as wheelchair 10 (shown in FIG. 1). FIG. 3 is an enlarged perspective view of a portion of a mounting system 72 used with back assembly 70 and including a lateral member 100 and a coupling assembly 74, and FIG. 4 is an exploded view of mounting system 72. FIG. 5 is a side perspective view of coupling assembly 74. FIGS. 6 and 7 are respectively an enlarged exploded view of an upper mounting bracket assembly 80 and a partially exploded enlarged view of a lower mounting bracket assembly 82 used with back assembly 70. FIG. 8 is a cross-sectional view of mounting system 72 coupled to upper mounting bracket assembly 80.

Wheelchair back assembly mounting system 72 is used to mount a relatively rigid shell member 84 to wheelchair back frame posts 38. More specifically, and as described herein, mounting system 72 provides a universal mounting system which enables shell member 84 to be coupled to a plurality of different wheelchairs 10 having different widths W and/or different support post diameters D (shown in FIG. 1). Moreover, mounting system 72 also enables shell member 84 to be coupled to posts 38 (shown in FIG. 1) which have a different curvature or tilt than those illustrated in FIG. 1. As such, mounting system 72 facilitates enabling wheelchair back assembly 70 to be retrofitted on existing wheelchairs, and/or installed as original equipment on new wheelchairs.

Shell member 84 is hard, relatively rigid matrix which is sized to extend laterally between wheelchair posts 38 to provide mechanical support to a back cushion (not shown) coupled thereto. Shell member 84 is contoured to facilitate providing lumbar support and lateral support to a seated user. More specifically, in the exemplary embodiment, the contour of shell member 84 also enables shell member 84 to generally conform to the slight backward bend of wheelchair posts 38. In an alternative embodiment, shell member 84 has a different contour and/or exterior shape defined by an outer perimeter of shell member 84. More specifically, the shell outer perimeter is defined by an upper edge 90, a lower edge 92, and a pair of opposite side edges 94 that extend between the upper and lower edges 90 and 92, respectively.

In the exemplary embodiment, mounting system 72 includes a pair of upper mounting bracket assemblies 80, a pair of lower mounting bracket assemblies 82, and lateral support member 100. Upper mounting bracket assemblies 80 facilitate removably coupling an upper portion 96 of shell member 84 to wheelchair back frame posts 38, and lower mounting bracket assemblies 82 facilitate removably coupling a lower portion 97 of shell member 84 to posts 38.

Lateral support member 100 is formed symmetrically about a center axis of symmetry 102 and is formed integrally with a pair of ends 104 and 106, and a body 108 extending therebetween. In one embodiment, lateral support member 100 is formed integrally with shell member 84. Body 108 has a width $W_B$ measured between an inner surface 112 and an outer surface 113 of body 108. In an alternative embodiment, lateral support member 100 is formed non-symmetrically. Inner surface 112 is contoured such that width $W_B$ is variable across body 108 between ends 104 and 106. More specifically, in the exemplary embodiment, body inner surface 112 has a contour that substantially matches a contour of shell member 84. Accordingly, and as described in more detail below, body inner surface 112 enables body 108 to substantially mate against a rear exterior surface 114 of shell member upper portion 96 when lateral support member 100 is coupled to shell member 84.

In the exemplary embodiment, lateral support member 100 is coupled against shell member 84 by a series of threaded fasteners (not shown) which extend through a plurality of openings (not shown) formed in shell member 84 and into corresponding openings (not shown) formed in, and extending into body 108 from body inner surface 112. In an alternative embodiment, support member 100 is coupled to body 108 using any coupling means that enables support member 100 to function as described herein.

Body 108 is also formed integrally with a handle portion 120 which, as described in more detail below, enables a user to selectively uncouple, or couple, shell member 84 from wheelchair back frame posts 38 using only one hand. More specifically, the combination of mounting system 72 and lateral member hand portion 120 enables even a user with limited hand functionality to install and/or remove shell member 84 to wheelchair back frame posts 38 in a single-handed operation.

Handle portion 120 is mechanically coupled to a pair of retaining pins 130 that are biased to extend radially outwardly through an opening 132 formed in each end 104 and 106. In the exemplary embodiment, pins 130 are biased through a spring-mechanism and are retractable when pressure is exerted to handle portion 120. More specifically, and as described in more detail below, when an upward force is induced to an activator portion 134 of handle portion 120, pins 130 are retracted, such that each pin 130 is drawn through opening 132 and into body 108.

Each end 104 and 106 of lateral member 100 is formed with a coupling portion 140 and an interlock portion 142. In the exemplary embodiment, coupling portion 140 is a male rail portion used within a tongue and groove coupling arrangement, and thus has a dovetail-shaped cross-sectional profile. In alternative embodiments, coupling portion 140 has a cross-sectional profile that is not dovetail-shaped. In another alternative embodiment, coupling portion 140 is formed as a female coupling portion within a tongue and groove coupling arrangement. More specifically, in the exemplary embodiment, coupling portion 140 extends widthwise from inner surface 112 for a length L to interlock portion 142. In an alternative embodiment, coupling portion 140 extends at least partially lengthwise between upper and lower sides 144 and 146, respectively, of support member 100. In a further alternative embodiment, coupling portion 140 extends only partially widthwise across each end 104 and 106 and as such does not extend from inner surface 112. Length L is shorter than body width $W_B$ measured adjacent each end 104 and 106. Moreover, in the exemplary embodiment, coupling portion 140 is substantially centered between upper and lower sides 144 and 146, respectively, of support member 100.

Because coupling portion length L is shorter than body width $W_B$, a coupling portion rear surface 150 is defined. More specifically, in the exemplary embodiment, surface 150 extends generally perpendicularly between an outer surface 152 of coupling portion 140 and a radially inner surface 154 of interlock portion 142. In the exemplary embodiment, an alignment pin opening 156 extends substantially concentrically through surface 150. Alignment pin opening 156 is sized to receive an alignment pin 158 therein, as described in more detail below.

Opening 132 extends through coupling portion 140 and is sized to receive a retracting pin 130 therethrough. More specifically, in the exemplary embodiment, opening 132 is substantially concentrically aligned within coupling portion 140 between upper and lower surfaces 144 and 146, respectively.

Interlock portion 142 extends from coupling portion surface 150 to lateral support member outer surface 113. In the exemplary embodiment, interlock portion 142 is recessed with respect an outer surface 157 of each end 104 and 106. Moreover, in the exemplary embodiment, interlock portion 142 has a generally rectangular recessed profile defined by surface 154. More specifically, and as described in more detail below, interlock portion 142 is sized to receive at least a portion of coupling assembly couplers 160 therein in an interlocked coupling arrangement. In an alternative embodiment, coupling portion 140 extends only partially widthwise across each end 104 and 106 and in such an embodiment, each end 104 and 106 can be formed with an interlock portions 142 at each end of coupling portion 140.

Coupling assembly 74 includes a pair of opposed couplers 160 that are in a mirrored relationship. Each coupler 160 is configured to releasably couple to each end 104 and 106 of lateral support member 100. In the exemplary embodiment, each coupler 160 includes a top side 162 and a bottom side 164 coupled together by an end wall 166, an opposite inner end wall 168, an inner surface 170, and an outer surface 172. Inner surface 170 is opposite outer surface 172 and may be contoured with a shape that substantially matches a contour of at least a portion of shell member 84. Coupler inner end wall 168 is contoured to substantially match a contour of at least a portion of shell member 84. Accordingly, and as described in more detail below, inner surface 168 enables coupler 160 to substantially mate against a portion of shell member rear exterior surface 114 when coupler 160 is coupled in position relative to back assembly 70.

Each coupler 160 is formed with a coupling portion 180 and an interlock portion 182. In the exemplary embodiment, coupling portion 180 is a female grooved portion used within a tongue and groove coupling arrangement, and thus has a recessed dovetail-shaped profile that is substantially similar to that of lateral member coupling portion 140. Accordingly, coupling portion 180 is sized to slidably engage lateral ends 104 and 106 in releasable contact. In alternative embodiments, coupling portion 180 has a recessed profile that is not dovetail-shaped, but rather is shaped substantially similar to that of lateral member coupling portion 140 to enable lateral member ends 104 and 106 to be coupled to couplers 160 in slidable contact. In another alternative embodiment, coupling portion 180 is formed as a male coupling portion within a tongue and groove coupling arrangement. More specifically, in the exemplary embodiment, coupling portion 180 extends widthwise from inner surface 168 for a length $L_C$ to coupler interlock portion 182. Depending on the contour of shell member 84, length $L_C$ is as long as, if not longer than, lateral member coupling portion 140. Accordingly, coupling portion 180 is sized to receive lateral member coupling portion 140 therein. Moreover, in the exemplary embodiment, coupling portion 180 is substantially centered between upper and lower sides 162 and 164, respectively, of support member 100.

In the exemplary embodiment, a retaining pin opening 190 extends through coupler 160 between outer surface 166 and inner surface 170. More specifically, opening 190 is substantially centered within coupling portion 180 between upper and lower sides 162 and 164, and each opening 190 is sized to receive a portion of a retaining pin 130 therein.

Coupler interlock portion 182 extends widthwise between coupling portion 180 and coupler outer surface 166, and projects radially outwardly from coupler inner surface 170. Coupler interlock portion 182 is shaped and sized to be received within lateral member recessed interlock portion 142. More specifically, when couplers 160 are coupled to lateral support member 100, lateral support member coupling portion 140 is slidably received within coupler coupling portion 180, and coupler interlock portion 182 is received within lateral member interlock portion 182 to facilitate securing coupler 160 and lateral support member 100 in an interlocking coupling arrangement. Accordingly, when coupler 160 is fully secured and removably coupled to lateral support member 100, coupler outer surface 166, will be substantially co-planar with lateral support member outer surface 113. Moreover, coupler upper and lower sides 162 and 164, respectively, will also be substantially co-planar with respective lateral support member upper and lower sides 144 and 146.

Alignment pin 158 extends outwardly from coupler interlock portion 182 into coupling portion 180. More specifically, in the exemplary embodiment, alignment pin 158 extends substantially perpendicularly from a radial inner surface 184 of interlock portion 182 and is substantially co-axially aligned with respect to coupling portion 180. Pin 158 is sized to be received within a respective alignment pin opening 156, and, as described in more detail below, facilitates aligning and securing lateral support member 100 with respect to coupler 160.

Coupler 160 also includes a plurality of fastener openings (not shown) extending at least partially through coupler 160 from coupler outer surface 172 towards coupler inner surface 170. In the exemplary embodiment, coupler 160 is coupled to mounting bracket assembly 80 using a plurality of threaded fasteners (not shown) which extend into, and/or through, the fastener openings formed in coupler 160. In an alternative embodiment, coupler 160 is coupled to bracket assembly 80 using any coupling means that enables coupler 160 to function as described herein.

In the exemplary embodiment, each upper mounting bracket assembly 80 is identical to each lower mounting bracket assembly 82, and each includes a frame member 200 that couples to an alignment member 202. Each frame member 200 includes a pair of fastening flanges 204 and an arcuate body 206 extending therebetween. Arcuate body 206 is contoured with a shape that enables an inner surface 210 of body 206 to substantially mate against an outer surface 212 (shown in FIG. 1) of a portion of a respective pole 38 when a respective bracket assembly 80 or 82 is securely coupled to pole 38. In the exemplary embodiment, arcuate body 206 is formed with a radius of curvature that is sized to receive at least a portion of a respective pole 38 therein.

Each fastening flange 204 includes a plurality of openings 214 extending therethrough. Each opening 214 is sized to receive a fastener (not shown) therethrough for coupling frame member 200 to alignment member 202. In the exemplary embodiment, fastening flanges 204 are substantially planar.

To facilitate reducing snag points, frame members 200 and alignment members 202 are sized approximately equal to each other based on the outer perimeters of each member 200 and 202. Accordingly, when portions 200 and 202 are coupled together, no edges overhang from either member 202 or 200. Alignment members 202 each include a plurality of orientation openings 212 formed therein which, as described in more detail below, facilitate selective orientation of shell member 84 with respect to wheelchair 10. More specifically, in the exemplary embodiment, openings 212 extend at least partially through member 202 from an alignment face 216 of member 202 to an inner surface 218 of member 202. Inner surface 218 is formed with an arcuate recessed portion 220 that is contoured with a shape that enables alignment member inner surface 218 to substantially mate against a portion of pole outer surface 212 when a respective bracket assembly 80 or 82 is securely coupled to pole 38. In the exemplary embodiment, arcuate recessed portion 220 is formed with a radius of curvature that is sized to receive at least a portion of a respective pole 38 therein.

Coupling assembly 74 is coupled to upper mounting bracket assembly 80 through a positioning bracket 230. More specifically, positioning bracket 230, as described in more detail below, not only enables each coupler 160 to be secured to each respective mounting bracket 80, but also enables each coupler to be variably positioned with respect to poles 38. In the exemplary embodiment, positioning bracket 230 includes a pair substantially perpendicular legs 232 and 234 coupled together such that bracket 230 has a substantially L-shaped cross-sectional profile. Alternatively, bracket 230 has a non-L-shaped cross-sectional profile. Each leg 232 and 234 includes a pair of slotted openings 236 and 238, respectively. In the exemplary embodiment, openings 236 or 238 are identically sized within each respective leg 232 and 234. In an alternative embodiment, slotted openings 236 and/or 238 may be any shape or size that enables positioning bracket 230 to function as described herein. In a further alternative embodiment, positioning bracket 230 does not include slotted openings 236 and/or 238 but rather includes a plurality of spaced openings which enable positioning bracket 230 to function as described herein.

Bracket leg 232 includes an outer surface 240 and an opposite inner surface 242. In the exemplary embodiment, leg 232 is substantially planar such that surfaces 240 and 242 are substantially parallel. Similarly, bracket leg 234 also includes an outer surface 244 and an inner surface 246, and in the exemplary embodiment, leg 234 is substantially planar such that surfaces 244 and 246 are substantially parallel. In an alternative embodiment, either leg 232 and/or 234 is non-planar. It should be noted that the illustrations of FIGS. 6 and 8 are merely exemplary and as such, bracket 230 may be fabricated with any size, or leg dimensions that enable bracket 230 to function as described herein. For example, although leg 234 is shown as having a longer length than leg 232, the lengths of legs 234 and 232 are variably selected depending on the dimensions of the wheelchair 10, such as post spacing W, back assembly 70 is coupled to.

Shell member lower portion 97 is removably coupled to lower mounting bracket assembly 82 through a positioning bracket 250. More specifically, positioning bracket 250, as described in more detail below, not only enables shell member 84 to be removably coupled to each post 38, but also facilitates orienting and/or variably positioning shell member lower portion 97 with respect to poles 38. In the exemplary embodiment, positioning bracket 250 includes a pair substantially perpendicular legs 252 and 254 coupled together such that bracket 250 has a substantially L-shaped cross-sectional profile. Alternatively, bracket 250 has a non-L-shaped cross-sectional profile. Leg 252 includes a pair of slotted openings 256 which facilitate variably positioning shell member 84 with respect to poles 38. In the exemplary embodiment, openings 256 are identically sized. In an alternative embodiment, slotted openings 256 may be any shape or size that enables positioning bracket 250 to function as described herein. In a further alternative embodiment, positioning bracket 250 does not include slotted openings 256 but rather includes a plurality of spaced openings which enable positioning bracket 250 to function as described herein.

Bracket leg 252 includes an outer surface 260 and an opposite inner surface 262. In the exemplary embodiment, leg 252 is substantially planar such that surfaces 260 and 262 are substantially parallel. Similarly, bracket leg 254 also includes an outer surface 264 and an inner surface 266, and in the exemplary embodiment, leg 254 is substantially planar such that surfaces 264 and 266 are substantially parallel. In an alternative embodiment, either leg 252 and/or 254 is non-planar. It should be noted that as illustrated, positioning bracket 250 is merely exemplary and as such, bracket 250 may be fabricated with any size, or leg dimensions that enable bracket 250 to function as described herein.

Bracket leg 254 is formed with an upper and a lower hinge bracket 270 and 272. Each bracket is sized to receive a sleeve 274 therein to facilitate hingedly coupling shell member 84 to mounting bracket assembly 82 through positioning bracket 250. More specifically, sleeve 274 is coupled to mounting bracket alignment member 202 by a fastener 276 inserted into any of the orientation openings 212 formed within member 202. Accordingly, in the exemplary embodiment, each hinge bracket 270 and 272 is formed with an arcuate portion 280 that has a radius of curvature that is sized to enable sleeve 274 to be received therein in close tolerance, and such that bracket 250 is then rotatably coupled to mounting bracket assembly 82, as is described in more detail below.

During use, wheelchair back assembly 70 facilitates mounting shell member 84 to wheelchair back frame posts 38, and more specifically, back assembly 70 includes a universal mounting system 72 which enables shell member 84 to be coupled to a plurality of different sized and/or shaped wheelchairs 10 having different post widths W and/or different support post diameters D. Moreover, mounting system 72 also enables shell member 84 to be coupled to wheelchair support posts 38 which have a different curvature or tilt than those illustrated in FIG. 1. Accordingly, wheelchair back assembly may be used to retrofit existing wheelchairs to replace existing back assemblies, and/or installed as original equipment on new wheelchairs.

When coupling back assembly 70 to a wheelchair 10 for the first time during a retrofit of an existing wheelchair 10, or during assembly of a newly manufactured wheelchair 10, initially lateral support member 100 is coupled to shell member 84 such that member 100 extends across the upper portion 96 of shell member 84 and between shell side edges 94. More specifically, when coupled in position, lateral member inner surface 112 is coupled tightly against shell member rear exterior surface 114, and handle portion 120 is positioned between shell upper edge 90 and lateral support member lower side 146. Moreover, once coupled to shell member 84, lateral support member 100 extends generally parallel to shell member upper edge 90.

A pair of positioning brackets 250 are then fixedly secured to shell member 84 along shell side edges 94. Depending on the design of wheelchair 10, bracket 250 may be secured to shell member lower portion 97 such that either leg surface 260 or 262 is secured tightly against shell member exterior surface 114. More specifically, each bracket 250 is secured to shell member 84 using a plurality of fasteners which extend through slotted openings 256 and at least partially through shell member 84. Alternatively, brackets 250 may be coupled to shell member 84 using any coupling means that enables brackets 250 to function as described herein. Moreover, in the exemplary embodiment, bracket slotted openings 256 enable each bracket hinge bracket 270 or 272 to be selectively positioned with respect to shell member 84 and with respect to posts 38.

Each mounting bracket assembly 80 and 82 is then securely coupled to each respective post 38. More specifically, bracket assembly frame member 200 is coupled to each respective alignment member 202 using a plurality of fasteners. Alternatively, mounting bracket assemblies 80 and 82 are secured to posts 38 using any coupling means that enables bracket assemblies 80 and 82 to function as described herein. Accordingly, when members 200 are securely coupled to members 202, each post 38 is secured between members 200 and 202. The combination of the multi-piece nature of bracket assemblies 80 and 82, and the radius of curvature of surfaces 220 and 206 enables bracket assemblies 80 and 82 to be used with support poles having a plurality of different diameters D.

A pair of positioning brackets 230 are then fixedly secured to upper mounting bracket assemblies 80. Depending on the design of wheelchair 10, each bracket 230 may be secured to shell member lower portion 97 such that the inner surface 242 or 246, or the outer surface 240 or 244 is secured tightly against mounting bracket alignment face 216. More specifically, each bracket 230 is secured to mounting bracket assembly 80 using a plurality of fasteners which extend through slotted openings 236 or 238 and at least partially through fastening flange openings 214. Alternatively, brackets 230 may be coupled to mounting bracket assemblies 80 using any coupling means that enables brackets 230 to function as described herein. Moreover, in the exemplary embodiment, the combination that either positioning bracket leg 232 or 234 may be coupled against mounting bracket assembly 80, and the bracket slotted openings 236 or 238 facilitate each positioning bracket 230 being variably positioned to selectively orient shell member upper portion 96 with respect to support poles 38 and with respect to wheelchair 10.

Coupling assembly 74 is then coupled to upper mounting bracket assembly 80 such that each coupler 160 is fixedly secured to each positioning bracket 230. More specifically, in the exemplary embodiment, each coupler 160 is coupled to each bracket 230 using a plurality of fasteners which are extended through the positioning bracket slotted openings 236 or 238 and at least partially into the fastener openings formed in coupler outer surface 172.

Each fastener 276 is then inserted through a respective sleeve 274 and inserted into an applicable orientation opening 212 formed within lower bracket assembly member 202. More specifically, the plurality of openings 212 enable shell member lower portion 97 to be variably positioned with respect to posts 38 and with respect to wheelchair 10.

Shell member lower portion 97 is then hingedly coupled to posts 38 through positioning brackets 250 and from the front side of wheelchair 10. More specifically, each positioning bracket 230 is positioned adjacent a respective lower bracket assembly member 202 such that each sleeve 274 is received within an the lower hinge bracket 270 and/or 272 on each positioning bracket 250.

Shell member 84 is then rotated backwards and away from a front edge of wheelchair 10 such that end 104 and 106 of lateral member 100 is slidably coupled to each respective coupler 160. More specifically, as shell member 84 is rotated backwards, each lateral member coupling portion 140 is received in slidable contact within each respective coupler coupling portion 180. As shell member 84 is rotated in a further direction backwards, each coupler interlock portion 182 is received within each respective lateral member interlock portion 142. More specifically, as interlock portion 182 is received within interlock portion 142, each alignment pin 158 is inserted in an interference fit within each respective lateral member opening 156. Additionally, once interlock portion 182 is fully seated within interlock portion 142, each retaining pin 130 is biased into, and received within, each respective coupler opening 190. Accordingly, once pins 130 are received within openings 190, lateral member 100 is removably coupled to each coupler 160, and thus to wheelchair 10, in an interlocked coupling arrangement. Moreover, the biasing of pins 130 prevents the inadvertent uncoupling of shell member from couplers 160.

Accordingly, when desired, a seated user may easily uncouple shell member 84 from wheelchair 10 using only one hand. More specifically, as a minimum force is applied to lateral member handle portion 120, retaining pins 130 are drawn into lateral support member 100 from openings 190. After pins 130 have been retracted from openings 190, shell member 84 may be rotated forward towards the front edge of wheelchair 10, such that each end 104 and 106 of lateral support member 100 is slidably uncoupled from each coupler 160. Continued rotation of shell member 84 uncouples shell member upper portion 96 from posts 38, such that shell member lower portion 97 may be uncoupled from posts 38 by merely lifting shell member 84 until each sleeve 274 is no longer positioned within an applicable lower hinge bracket 270 and/or 272. The remaining back assembly mounting system hardware remains coupled to wheelchair 10, even if wheelchair 10 is folded for storage and/or transportation.

As such, the combination of brackets 230 and 250, and mounting bracket assemblies 80 and 82 enable shell member 84 to be selectively adjusted relative to the wheelchair 10. Specifically, bracket assemblies 80 and 82 accommodate height adjustments that may be required, such that shell member 84 may be raised or lowered along wheelchair posts 38. Moreover, brackets 230 and 250 enable all, or a portion such as 96 or 97 of shell member 84, to be tilted forward or rearward to accommodate the stabilization and therapeutic requirements of the seated user. Accordingly, wheelchair back assembly 84 is easily adjustable, and is easily attached or detached from wheelchair 10 in a single-hand operation.

The above-described wheelchair back assembly provides a user with a high degree of support and adjustablity, and thus accommodates a plurality of therapeutically significant adjustments and orientations. Specifically, the wheelchair back assembly includes a universal mounting system that is usable with a plurality of different sized and shaped wheelchairs. The mounting system is removably coupled to the wheelchair in a manner that enables a user to easily detach and reattach the shell member to the wheelchair, even a user having limited hand dexterity or function. An upper portion of the shell member is slidably coupled to the wheelchair posts in an interlocking coupling arrangement that prevents the inadvertent uncoupling of the shell member from the wheelchair. The lower portion of the shell member is pivotally coupled to the wheelchair posts in a hinged coupling arrangement. As a result, a removable wheelchair back assembly is provided which facilitates increasing the adjustability options available to a user in a cost-effective and reliable manner.

Exemplary embodiments of wheelchair back assemblies are described above in detail. Although the back assemblies are herein described and illustrated in association with seated users, it should be understood that the present invention may be used with a plurality of different wheelchairs. Moreover, it should also be noted that the components of each wheelchair back assembly are not limited to the specific embodiments described herein, but rather, aspects of each back assembly component and method of assembly may be utilized independently and separately from other methods described herein.

In addition, although in the described embodiment, the angular movement of the wheelchair shell member is in a generally vertical plane when the shell member is being attached to or detached from the wheelchair posts, in alternative embodiments, the wheelchair shell member could be moved in a generally horizontal rotational plane or at some other angular orientation as well. Furthermore, instead of the lower positioning brackets being the direct pivot point, alternate pivot points could be formed along the sides of the shell member, and/or fitted to a shape on the posts, in order to get the same type of rotational movement and hinged coupling.

In addition, although the wheelchair back assembly is described has having four mounting bracket assemblies, in alternative embodiments, the back assembly could have more or less than four mounting assemblies, depending on the desired application. Moreover, the lower mounting assemblies do not have to be hingedly coupled, but rather some other removable coupling means, such as the same coupling arrangement used with the upper mounting assemblies, could be used.

While the invention has been described in terms of various specific embodiments, those skilled in the art will recognize that the invention can be practiced with modification within the spirit and scope of the claims.

What is claimed is:

1. A wheelchair back assembly for mounting to a pair of spaced apart laterally-aligned support posts of a wheelchair back frame, said back assembly comprising:

a relatively rigid shell member;

a mounting system for coupling said shell member to the wheelchair back frame, said mounting system comprising at least a first mounting bracket assembly, a second mounting bracket assembly, and a lateral member configured to be coupled to said first and second mounting bracket assemblies such that said lateral member extends from said first mounting bracket assembly to said second mounting bracket assembly, said first mounting bracket assembly configured to couple to a first of the wheelchair back frame support posts, said second mounting bracket assembly is configured to couple to the second of the wheelchair back frame support posts, said lateral member is selectively operable to uncouple said shell member from the wheelchair back frame; and a coupling system for removably coupling said shell member to said mounting system, said coupling system comprising a first coupler assembly configured to couple to said first mounting bracket assembly and a second coupler assembly configured to couple to said second mounting bracket assembly, said lateral member comprises at least one biasing member configured to bias said lateral member into coupling contact with at least one of said coupler assemblies.

2. A wheelchair back assembly in accordance with claim 1 wherein said first and second coupler assemblies are each configured to be removably coupled to a respective end of said lateral member.

3. A wheelchair back assembly in accordance with claim 1 wherein at least one of said first and second coupler assemblies is configured to slidably couple to said lateral member.

4. A wheelchair back assembly in accordance with claim 1 wherein at least one of said first and second coupler assemblies is configured to couple to said lateral member through a tongue and groove coupling arrangement.

5. A wheelchair back assembly in accordance with claim 1 wherein at least one of said first and second coupler assemblies is configured to couple to said lateral member such that said lateral member and said coupler assembly are interlocked.

6. A wheelchair back assembly in accordance with claim 1 wherein at least one of said first and second coupler assemblies comprises an alignment pin sized to be at least partially received within an opening defined within said lateral member.

7. A wheelchair back assembly in accordance with claim 6 wherein said alignment pin facilitates positioning said lateral member with respect to said coupler assembly.

8. A wheelchair back assembly in accordance with claim 1 wherein said lateral member comprises a pair of ends and a body extending laterally therebetween, said body is coupled against said shell member, each of said lateral member ends is removably coupled to a respective said coupler assembly.

9. A wheelchair back assembly in accordance with claim 8 wherein said lateral member at least one biasing mechanism is configured to bias said lateral member into coupling contact with each of said coupler assemblies.

10. A wheelchair back assembly in accordance with claim 1 wherein said at least one biasing mechanism comprises a retractable retaining pin, each said retaining pin is sized to be received at least partially within an opening defined in said coupler assemblies.

11. A wheelchair back assembly in accordance with claim 1 wherein said biasing mechanism is selectively operable to uncouple said shell member from the wheelchair back frame.

12. A wheelchair back assembly in accordance with claim 1 wherein said at least one biasing mechanism is configured for single-handed release of said shell member from the wheelchair back frame.

13. A wheelchair back assembly in accordance with claim 1 wherein said lateral member comprises a hand grip device, said hand grip device is selectably operable to uncouple said shell member from the wheelchair back frame.

14. A wheelchair back assembly in accordance with claim 12 wherein said hand grip device is configured for single-handed release of said shell member from the wheelchair back frame.

15. A wheelchair back assembly in accordance with claim 1 wherein said lateral member is configured to enable single-handed release of said shell member from the wheelchair back frame.

16. A wheelchair back assembly in accordance with claim 1 wherein said mounting assembly further comprises a third mounting bracket assembly and a fourth mounting bracket assembly, said third and fourth mounting bracket assemblies configured to couple said shell member to the wheelchair back frame such that said third mounting bracket assembly is coupled to the first wheelchair back frame support post and said fourth mounting bracket assembly is coupled to the second wheelchair back frame support post.

17. A wheel chair back assembly in accordance with claim 16 wherein said third and fourth mounting bracket assemblies are each configured to pivotally couple said shell member to the second wheelchair back frame support post.

18. A wheel chair back assembly in accordance with claim 16 wherein said third and fourth mounting bracket assemblies each comprise a plurality of openings defined therein, said openings for positioning said shell member with respect to the wheelchair back frame.

19. A wheelchair comprising:

a back frame comprising a pair of spaced-apart support posts, said support posts are substantially laterally-aligned; and a back assembly comprising a relatively rigid shell member coupled between said pair of support posts, and a mounting system for slidably coupling said shell member to said back frame, said mounting system comprising a first mounting bracket assembly, a second mounting bracket assembly, a third mounting bracket assembly, and a lateral member coupled between said first and second mounting bracket assemblies, said lateral member is configured to extend from said first mounting bracket assembly to said second mounting bracket assembly and couple to each of said support posts and is selectively operable to uncouple said shell member from said back frame, said third mounting bracket assembly is configured to couple to said back frame such that said first and third mounting bracket assemblies are coupled to different portions of a first of said pair of support posts, and such that said second mounting bracket assembly is coupled to a second of said pair of support posts.

20. A wheelchair in accordance with claim 19 wherein said lateral member is configured for single-handed release of said shell member from said wheelchair back frame.

21. A wheelchair in accordance with claim 20 wherein said lateral member comprises a hand grip device.

22. A wheelchair in accordance with claim 19 wherein said back assembly further comprises a coupling system for removably coupling said shell member to said mounting system.

23. A wheelchair in accordance with claim 22 wherein said lateral member comprises a pair of ends and a body extending therebetween, said coupling system is configured to be removably coupled to each of said body ends.

24. A wheelchair in accordance with claim 23 wherein said lateral member comprises a pair of retaining pins configured to securely couple said shell member in position relative to said back frame.

25. A wheelchair in accordance with claim 24 wherein said pair of retaining pins are selectively retractable to facilitate uncoupling said shell member from said back frame.

26. A wheelchair in accordance with claim 22 wherein said lateral member comprises a pair of ends and a body extending therebetween, said coupling system is configured to slidably couple to each of said body ends.

27. A wheelchair in accordance with claim 22 wherein said lateral member comprises a pair of ends and a body extending therebetween, said coupling system is configured to couple to each of said body ends through a tongue and groove coupling arrangement.

28. A wheelchair in accordance with claim 22 wherein said lateral member comprises a pair of ends and a body extending therebetween, said coupling system is configured to slidably couple to each of said body ends.

29. A wheelchair in accordance with claim 22 wherein said lateral member is configured to couple with said coupling system such that said lateral member is interlocked to said coupling system.

30. A wheelchair in accordance with claim 29 wherein said coupling system comprises at least one alignment pin configured to facilitate interlocking between said lateral member and said coupling system.

31. A wheelchair in accordance with claim 19 wherein said mounting system further comprises a fourth mounting bracket assembly, said second and fourth mounting bracket assemblies are coupled to different portions of said second of said pair of support posts.

32. A wheelchair in accordance with claim 19 wherein said mounting system further comprises a third mounting bracket assembly and a fourth mounting bracket assembly, said third and fourth mounting bracket assemblies are configured to pivotally couple said shell member to said back frame.

33. A wheelchair in accordance with claim 19 wherein said mounting system further comprises a third mounting bracket assembly and a fourth mounting bracket assembly, said third and fourth mounting bracket assemblies are configured to couple said shell member to said back frame, each of said third and fourth mounting bracket assemblies comprises a plurality of openings for selectively positioning said shell member with respect to said back frame.

34. A back assembly for a wheelchair including a pair of laterally aligned support posts, said back assembly comprising: a shell member comprising an upper portion, a lower portion, and a lateral member, said shell member lower portion is pivotally coupled to the support posts; and a mounting system for slidably coupling said shell member between the support posts, said mounting system comprising a first mounting bracket assembly, a second mounting bracket assembly, and a coupling assembly, said first mounting bracket assembly configured to couple said shell upper portion to a first of the support posts, said second mounting bracket assembly configured to couple said shell upper portion to a second of the support posts, said coupler assembly configured to couple between said first mounting bracket assembly and said shell member, and between said second mounting bracket assembly and said shell member, said lateral member extends across said shell member upper portion and is configured to be selectively operable to uncouple said shell member from said coupler assembly, said lateral member is biased into contact with said coupler assembly, said mounting system further comprises a third mounting bracket assembly, and a fourth mounting bracket assembly, said third mounting bracket assembly configured to couple said shell lower portion to the first support post, said fourth mounting bracket assembly configured to couple the shell upper portion to the second support post.

35. A back assembly in accordance with claim 34 wherein said lateral member is configured for single-handed release of said shell member from the wheelchair support posts.

36. A back assembly in accordance with claim 34 wherein said lateral member is slidably coupled to said coupling assembly.

37. A back assembly in accordance with claim 34 wherein said lateral member is coupled to said coupling assembly through a tongue and groove coupling arrangement.

38. A back assembly in accordance with claim 34 wherein said lateral member is coupled to said coupling assembly through an interlocking coupling arrangement.

39. A back assembly in accordance with claim 34 wherein said third and fourth mounting bracket assemblies are configured to pivotally couple said shell member to the support posts.

* * * * *